US005827078A

United States Patent [19]

Simonian

[11] Patent Number: 5,827,078

[45] Date of Patent: Oct. 27, 1998

[54] CONNECTOR ACCESSORIES, ELECTRICAL, BACKSHELL, GROUNDING, FLEX CABLES

[76] Inventor: Christopher L. Simonian, 901 Stewarton Way, Glendale, Calif. 91207

[21] Appl. No.: 771,759

[22] Filed: Dec. 20, 1996

[51] Int. Cl.[6] ..... H01R 4/66; H01R 13/62

[52] U.S. Cl. ..... 439/95; 439/939

[58] Field of Search ..... 439/92, 95, 97, 439/307, 312, 320, 321, 339, 608, 610, 939

[56] References Cited

U.S. PATENT DOCUMENTS 4,867,692 9/1989 Kerek ..... 439/939
4,902,238 2/1990 Iacobucci ..... 439/135
5,435,760 7/1995 Miklos ..... 439/321
5,580,278 12/1996 Fowler et al. ..... 439/321

*Primary Examiner*—Neil Abrams
*Assistant Examiner*—Brian J. Biggi
*Attorney, Agent, or Firm*—Leonard A. Alkov; Glenn H. Lenzen, Jr.

[57] ABSTRACT

A connector having improved grounding. The connector has a rotatable ground contact flange formed as part of a backshell that is rotated to mate with a grounding tab that is part of a rigid/flex cable. The connector shell has a plurality of connector pins that are soldered to vias formed in a rigid portion of the rigid/flex cable. Once the ground contact flange and grounding tab are mated, the backshell is secured to a connector shell to produce excellent grounding of the rigid/flex cable to the connector shell.

11 Claims, 2 Drawing Sheets

CONNECTOR ACCESSORIES, ELECTRICAL, BACKSHELL, GROUNDING, FLEX CABLES

BACKGROUND

The present invention generally relates to electrical connector grounding arrangements, and more particularly, to a connector having improved grounding between a rigid/flex flexible cable ground shield and the body of the connector.

The prior art relating to rigid/flex grounding arrangements for electrical connectors is as follows. The conventional grounding approaches have various disadvantages. Heretofore, rigid/flex flexible cable shields were connected through preassigned connector ground pins that were indirectly grounded though a mating connector. However, this required the formation of a pigtail for the shield. The use of such pigtails to make shield connections is not considered to be good practice and is therefore not acceptable. Conventional shield connections may be made using a metal "Band-it" and bracket connection between a connector shell and a rigid/flex flexible cable shield. However, this arrangement may create coefficient of thermal expansion problems. A direct connection has heretofore been made between built-in spacers of the connector and the rigid/flex flexible cable shield. However, this arrangement may also create coefficient of thermal expansion problems.

Accordingly, it is an objective of the present invention to provide for a connector having improved grounding between a rigid/flex flexible cable ground shield and the body of the connector.

SUMMARY OF THE INVENTION

To meet the above and other objectives, the present invention provides for a connector having improved grounding between a rigid/flex flexible cable ground shield and a connector backshell that provides for improved electromagnetic interference (EMI) hardening. The connector has a connector shell with a plurality of connector pins extending therefrom. The backshell has a ground contact flange with a slot therein. The ground contact flange is free to rotate around an axis of the backshell. A coupling nut that is captivated by the backshell is used to secure the backshell to the connector shell. A rigid/flex cable is provided that has a rigid portion with a plurality of vias therein that are electrically connected to the connector pins, and a flexible portion that extends from the rigid portion that is used to connect to an electrical component through circuit traces. The rigid/flex cable has a grounding tab that is connected to the rigid portion by a short piece of flexible cable, and the grounding tab has an opening therein that mates with the slot in the ground contact flange.

The ground contact flange of the backshell rotates to a desired location so that it is aligned with the rigid/flex cable grounding tab. The surfaces of the ground contact flange and the grounding tab are fastened together. After engaging threads on the coupling nut with threads on the connector shell, excellent electrical bonding of the connector shell to the rigid/flex cable shield is achieved. The present invention may be used where rigid/flex cables and circular connectors are used for EMI shielding and electrical bonding.

The present invention thus simplifies grounding of a rigid/flex cable to a connector backshell. The method of assembly and the time it takes to do so are thus improved. The present invention provides for a reduction in the number of components and the elimination of soldering processes to ground rigid/flex cables to the connector backshell. The reliability and grounding effectiveness of the connector are enhanced, and there is no mismatch between different coefficients of thermal expansion. The present invention eliminates problems in mating connector soldered pins (with different crimped lengths) to the rigid portion of rigid/flex cable (with hard fastening to the connector backshell). The present invention reduces the number of parts required in the connector, including elimination of pigtail wires, Band-it's and brackets. The present invention eliminates special tooling for Band-it clamping. The present invention reduces assembly time and cost. The present invention improves the rigid/flex cable shielding effectiveness with short grounding tabs.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
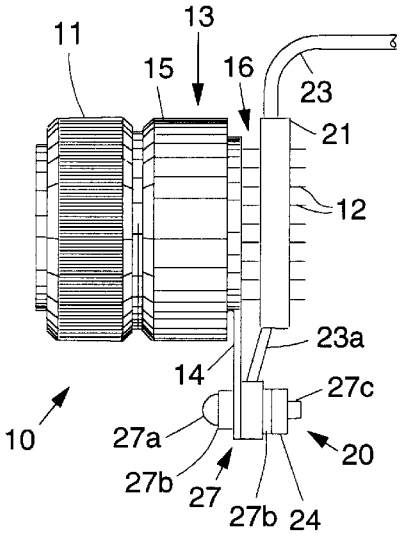
FIG. 1 illustrates a connector made in accordance with the principles of the present invention.
Figure 2:
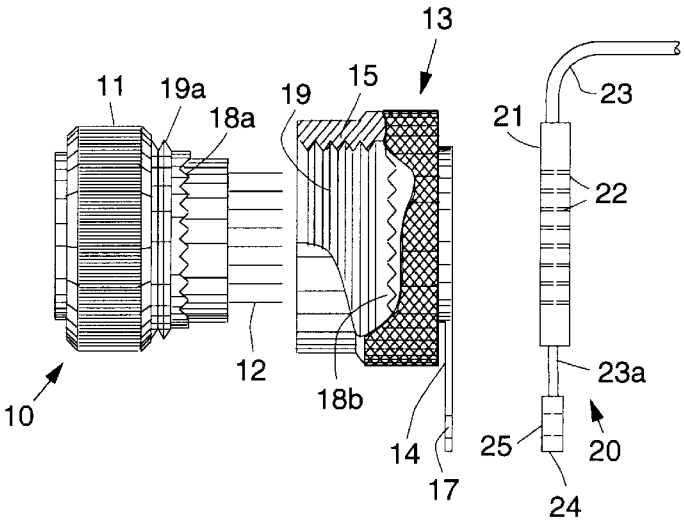
FIG. 2 illustrates an exploded view of the connector of FIG. 1.
Figure 4A:
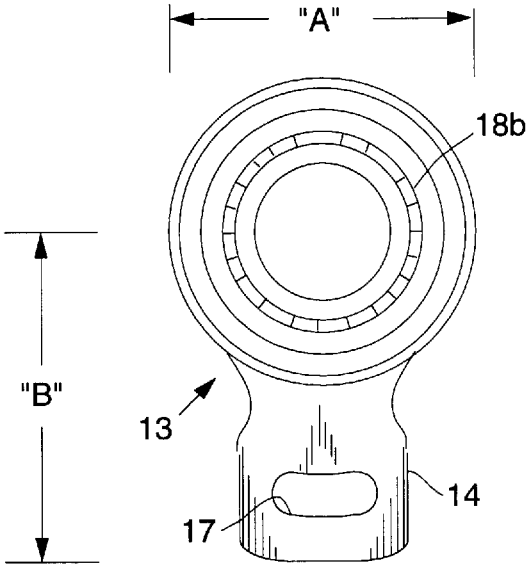
FIGS. 4*a* and 4*b* illustrate front and side views, respectively, of a first backshell that may be used in the connector of FIG. 1.

Referring to the drawing figures, FIG. 1 illustrates a connector 10 made in accordance with the principles of the present invention. FIG. 2 illustrates an exploded view of the connector 10 of FIG. 1. The connector 10 comprises a circular connector shell 11 having a plurality of connector pins 12, a backshell 13 having a ground contact flange 14, a coupling nut 15 used to secure the backshell 13 to the connector shell 11, and a rigid/flex cable 20 that is soldered to the connector pins 12 of the circular connector shell 11. The coupling nut 15 is captivated by the ground contact flange 14 and is free to rotate. The ground contact flange 14 has a slot 17 therein (FIGS. 2 and 4*a*). The ground contact flange 14 is free to rotate around an axis of the connector 10.

The rigid/flex cable 20 has a rigid portion 21 having holes or vias 22 therethrough through which the connector pins 12 of the circular connector shell 11 pass. The connector pins 12 are electrically connected and secured in the vias 22 by means of solder, for example. The rigid/flex cable 20 has a relatively long flexible portion 23 that extends from the rigid portion 21 that is used to connect to an electrical component (not shown) through circuit traces. The rigid portion 21 of the rigid/flex cable 20 is separated from the ground contact flange 14 by a small gap 16, which may be on the order of 0.04 inches, for example, to permit removal of flux after soldering of the connector pins 12 to the rigid portion 21 of the rigid/flex cable 20.

The rigid/flex cable 20 has a grounding tab 24 that is connected to the rigid portion 21 by a short piece of flexible cable 23*a*. The grounding tab 24 has an opening 25 therein that mates with the slot 17 in the ground contact flange 14. The ground contact flange 14 is rotated so that the slot 17 therein is aligned with the opening 25 in the grounding tab

24. The ground contact flange 14 provides a ground contact between the rigid/flex cable 20 and the flange 14 of the backshell 13 using fastening hardware 27 such as a machine screw 27*a*, two flat washers 27*b* and a nut 27*c*, for example.

Figure 3A:
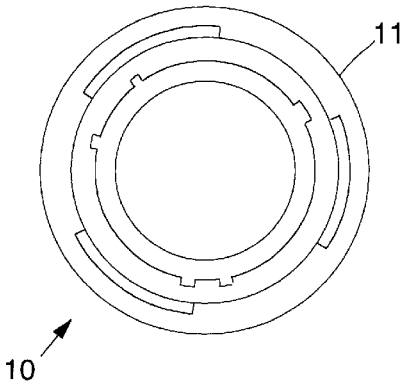
FIGS. 3*a* and 3*b* illustrate front and side views, respectively, of a connector shell used in the connector of FIG. 1.
Figure 3B:
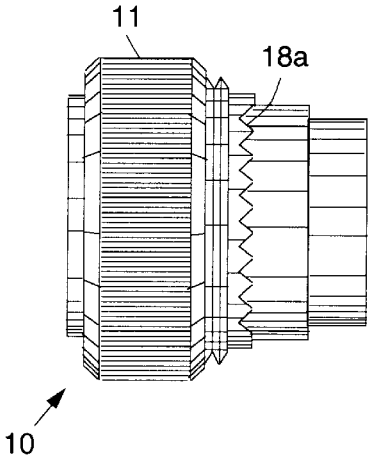
Figure 4B:
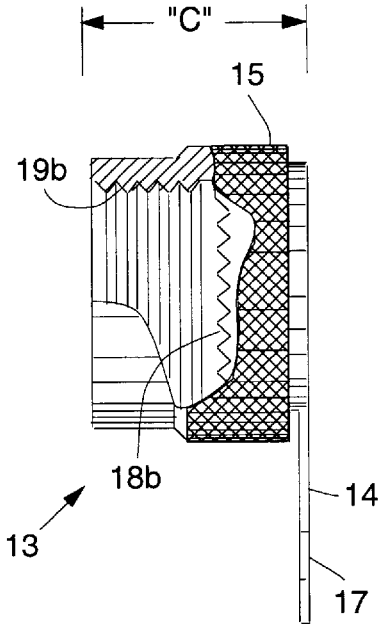
Figure 4C:
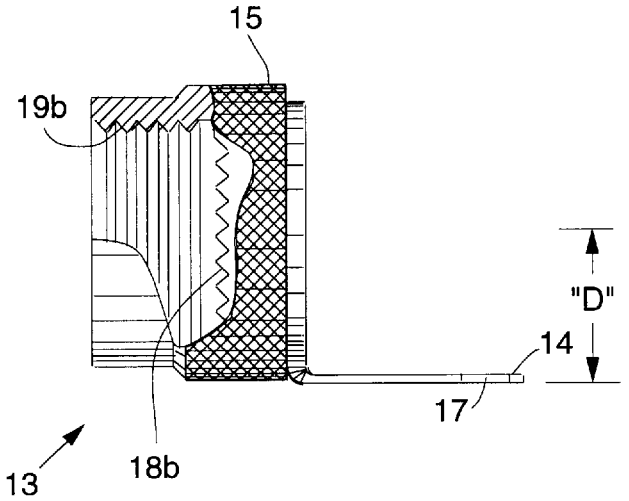
FIG. 4*c* illustrates a side view of a second backshell that may be used in the connector of FIG. 1.

FIGS. 3*a* and 3*b* illustrate front and side views, respectively, of the connector shell 11, while FIGS. 4*a* and 4*b* illustrate front and side views, respectively, of one embodiment of the backshell 13 wherein the ground contact flange 14 is flat. FIG. 4*c* illustrates a side view of a second embodiment of the backshell 13. The second embodiment of the ground contact flange 14 is formed in an "L" shape. The connector shell 11 and backshell 13 used in a reduced to practice embodiment of the present invention are similar to those of a MIL-C-38999 connector 10 but the MIL-C-85049 backshell 13 is modified to permit rotation of the ground contact flange 14 to desired orientation with the grounding tab 24.

The connector shell 11 also has external threads 19*a* that mate with internal threads 19*b* of the coupling nut 15 of the backshell 13. The connector shell 11 has a plurality of connector shell teeth 18*a* that mate with a corresponding plurality of backshell teeth 18*b* in the interior of the backshell 13. When the backshell 13 is fully engaged with the connector shell 11, both sets of teeth 18*a*, 18*b* contact each other to lock the ground contact flange 14 and prevent it from rotating.

The gap 16 between the ground contact flange 14 and the rigid/flex cable 20 also permits decoupling the coupling nut 15 to disengage the threads 19*b* of the coupling nut 15 from the mating threads 19*a* of the connector shell 11. Disengaging the respective threads 19*a*, 19*b* allows the ground contact flange 14 to swivel around the rigid portion 21 of rigid/flex cable 20, so that it can freely align with the rigid grounding tab 24, which is disposed at a fixed location.

When the connector shell 11 and backshell 13 are disengaged, the ground contact flange 14 is free to rotate or spin, which allows it to orient with the grounding tab 24 at any desired location. Thus, the ground contact flange 14 and the rigid/flex cable 20 shield are grounded to the connector shell 11, when the surfaces of the connector shell 11 and backshell 13 are fastened together.

By disengaging the backshell 13 from the connector shell 11, the respective threads 19*b*, 19*a* are disengaged from each other, and are separated by a maximum distance of 0.030 inches for MIL-C-38999 Series I & II type connectors 10, and to a maximum distance of 0.79 millimeters for metric threads of Series III & IV type connectors 10. The disengagement distances for the backshell 13 of the MIL-C-38999 connector 10 depends on the particular size of the backshell 13. MIL-C-38999 Series I & II backshell sizes are given in Table 1. Tables 2 and 3 show dimensions for MIL-C-38999 Series I and II and Series III and IV connectors 10, respectively, that may be constructed in accordance with the present invention. Dimensions "A", "B", "C" and "D" are shown in FIGS. 4*a–c*.

TABLE 1

| Shell size | Thread size | Number of threads (0.030 distance) |
|---|---|---|
| 8 | 7/16–28 | 0.84 |
| 10 | 9/16–24 | 0.72 |
| 12 | 11/16–24 | 0.72 |
| 14 | 13/16–20 | 0.60 |
| 16 | 15/16–20 | 0.60 |
| 18 | 1 1/16–18 | 0.54 |
| 20 | 1 3/16–18 | 0.54 |

TABLE 1-continued

| Shell size | Thread size | Number of threads (0.030 distance) |
|---|---|---|
| 22 | 1 5/16–18 | 0.54 |
| 24 | 1 7/16–18 | 0.54 |

TABLE 2

| Back-shell Dash No. | Shell size Series I | Shell size Series II | "A" Dia. Max Self-Lock | "A" Dia. Max Non Self-Lock | "B" ±0.010 Self-Lock | "B" ±0.010 Non Self-Lock | "C" Max Self-Lock | "C" Max Non Self-Lock | "D" |
|---|---|---|---|---|---|---|---|---|---|
| 8 | 9 | 8 | 0.86 | 0.75 | 1.03 | 0.975 | 0.59 | 0.39 | 0.600 |
| 10 | 11 | 10 | 0.98 | 0.85 | 1.09 | 1.025 | 0.59 | 0.39 | 0.650 |
| 12 | 13 | 12 | 1.16 | 1.00 | 1.18 | 1.19 | 0.59 | 0.39 | 0.750 |
| 14 | 15 | 14 | 1.28 | 1.10 | 1.24 | 1.15 | 0.59 | 0.39 | 0.775 |
| 16 | 17 | 16 | 1.41 | 1.25 | 1.31 | 1.225 | 0.59 | 0.39 | 0.850 |
| 18 | 19 | 18 | 1.52 | 1.40 | 1.36 | 1.3 | 0.59 | 0.39 | 0.925 |
| 20 | 21 | 20 | 1.64 | 1.50 | 1.42 | 1.35 | 0.59 | 0.39 | 0.975 |
| 22 | 23 | 22 | 1.77 | 1.65 | 1.49 | 1.425 | 0.59 | 0.39 | 1.050 |
| 24 | 25 | 24 | 1.89 | 1.75 | 1.55 | 1.475 | 0.59 | 0.39 | 1.100 |

TABLE 3

| Backshell Dash No. | Shell size Series III & IV | "A" Dia. | "B" ±0.010 | "C" | "D" |
|---|---|---|---|---|---|
| 9 | 9 | 0.75 | 0.975 | 0.45 | 0.600 |
| 11 | 11 | 0.85 | 1.025 | 0.45 | 0.650 |
| 13 | 13 | 1.00 | 1.100 | 0.45 | .0750 |
| 15 | 15 | 1.15 | 1.180 | 0.45 | 0.775 |
| 17 | 17 | 1.25 | 1.220 | 0.45 | 0.850 |
| 19 | 19 | 1.40 | 1.300 | 0.45 | 0.927 |
| 21 | 21 | 1.55 | 1.380 | 0.45 | 0.975 |
| 23 | 23 | 1.65 | 1.425 | 0.45 | 1.050 |
| 25 | 25 | 1.85 | 1.525 | 0.45 | 1.100 |

Thus, a connector having improved grounding between a rigid/flex flexible cable ground shield and the body of the connector has been disclosed. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A connector comprising:

a connector shell having a plurality of connector pins;

a backshell comprising a ground contact flange having a slot therein, and wherein the ground contact flange is free to rotate around an axis of the backshell;

a coupling nut that is captivated by the ground contact flange for securing the backshell to the connector shell; and a rigid/flex cable comprising a rigid portion having a plurality of vias therein to which the connector pins are electrically connected, a flexible portion that extends from the rigid portion that is used to connect to an electrical component through circuit traces, and a grounding tab connected to the rigid portion by a short piece of flexible cable, and wherein the grounding tab has an opening therein that mates with the slot in the ground contact flange.

2. The connector of claim 1 wherein the connector pins are electrically connected to the vias by solder.

3. The connector of claim 1 wherein the rigid portion of the rigid/flex cable is separated from the ground contact flange by a small gap.

4. The connector of claim 1 wherein the ground contact flange is coupled to the grounding tab by means of a machine screw, at least one flat washer, and a nut.

5. The connector of claim 1 wherein the connector shell comprises a plurality of connector shell teeth that mate with a corresponding plurality of backshell teeth disposed on the ground contact flange of the backshell, and wherein when the backshell and connector shell are mated together, the teeth make contact with each other to lock the ground contact flange and prevent it from rotating.

6. The connector of claim 1 wherein the circular connector shell has external threads that mate with internal threads of the coupling nut.

7. A connector comprising:

a connector shell having a plurality of connector pins and external threads;

a backshell having internal threads that mate with the external threads of the connector shell, and a ground contact flange having a slot therein, and wherein the ground contact flange is free to rotate around an axis of the backshell;

a coupling nut that is captivated by the ground contact flange for securing the backshell to the connector shell; and a rigid/flex cable comprising a rigid portion having a plurality of vias therein to which the connector pins are electrically connected, a flexible portion that extends from the rigid portion that is used to connect to an electrical component through circuit traces, and a grounding tab connected to the rigid portion by a short piece of flexible cable, and wherein the grounding tab has an opening therein that mates with the slot in the ground contact flange.

8. The connector of claim 7 wherein the connector pins are electrically connected to the vias by solder.

9. The connector of claim 7 wherein the rigid portion of the rigid/flex cable is separated from the ground contact flange by a small gap.

10. The connector of claim 7 wherein the ground contact flange is coupled to the grounding tab by means of a machine screw, at least one flat washer, and a nut.

11. The connector of claim 7 wherein the connector shell comprises a plurality of connector shell teeth that mate with a corresponding plurality of backshell teeth disposed on the ground contact flange of the backshell, and wherein when the backshell and connector shell are mated together, the teeth make contact with each other to lock the ground contact flange and prevent it from rotating.

* * * * *